United States Patent [19]

Irvine et al.

[11] 4,030,723

[45] June 21, 1977

[54] VACUUM-CONTROLLED, SHEET-MATERIAL SEPARATOR AND FEEDER SYSTEM

[75] Inventors: Robert Irvine, Riverside; Harry E. Luperti, Wilton, both of Conn.

[73] Assignee: Pitney-Bowes, Inc., Stamford, Conn.

[22] Filed: Dec. 15, 1975

[21] Appl. No.: 640,900

[52] U.S. Cl. ..... 271/11; 271/94; 271/104; 271/112; 271/116; 271/121; 271/259

[51] Int. Cl.[2] ..... B65H 3/10; B65H 7/18

[58] Field of Search ..... 271/8 A, 10–13, 271/90, 94, 96, 99, 104, 110, 111, 112, 114, 116, 121, 124, 258, 259, 265

[56] References Cited

UNITED STATES PATENTS

| | | | |
|---|---|---|---|
| 3,025,052 | 3/1962 | Gutteling | 271/94 |
| 3,126,201 | 3/1964 | Rehm | 271/104 |
| 3,730,514 | 5/1973 | Burkhardt | 271/96 X |
| 3,981,493 | 9/1976 | Klappenecker et al. | 271/10 |
| 3,988,014 | 10/1976 | Kuhl | 271/10 X |

FOREIGN PATENTS OR APPLICATIONS

| | | | |
|---|---|---|---|
| 2,309,756 | 9/1974 | Germany | 271/265 |

*Primary Examiner*—Robert W. Saifer
*Attorney, Agent, or Firm*—Robert S. Salzman; William D. Soltow, Jr.; Albert W. Scribner

[57] ABSTRACT

A high speed, vacuum-controlled sheet-material separating and feeder system is disclosed which handles a wide range of mixed thicknesses and sizes of envelopes and sheets. The vacuum feeding of this system reduces frictional wear on the feed and separating rollers. The sheets are stacked at one end of the system, and are fed to a first of two vacuum-controlled separator mechanisms. The first separator mechanism is adjusted for thicker sheets of the range. Sheets leaving the first separator are then fed to the second of the two separator mechanisms. The second separator is adjusted for thinner sheets of the range. Sheets leaving the second separator are ejected one at a time, in seriatim, where they then can be fed to other sheet handling equipment for processing.

29 Claims, 7 Drawing Figures

10
11
12
13
14
15
16
16'
17
18
19
20
21
22
23
24
25
26
27
28
29
30
31
35
36
38
39
40
45
46
70
71
d 14
16
16'
17
18
19
26
27
28
29
36
38
41
42
43
46

15
45
46
39
38
70
71
15
35
36
16'
28'
62
29'
59
47
31
53
67
25
26
16
18'
61
60
19'
37
21
53
58
22
57
23
24
10
51
14'
13
11
12
53

38
46
28'
29'
36
43
52
59
18'
19'
26
42
52
58
14'
41
52
54
53
52

VACUUM-CONTROLLED, SHEET-MATERIAL SEPARATOR AND FEEDER SYSTEM

The invention pertains to sheet-handling equipment, and more particularly to a vacuum-controlled sheet-material separator and feeder system.

RELATED APPLICATION

The present invention is related to copending application Ser. No. 577,002; filed: May 13, 1975.

BACKGROUND OF THE INVENTION

This invention is an improvement of the separator and feeder system shown and described in application Ser. No. 577,002; filed: May 13, 1975.

This present system functions and operates in a similar way as the prior system, with the exception of providing a vacuum-control for the feed and separator elements. This vacuum-control allows for the elimination of high frictionally engaging parts. This in turn reduces wear, and allows for reduced maintenance and longer machine life.

SUMMARY OF THE INVENTION

The invention is for a vacuum-controlled sheet-material separating and feeding system for handling a wide range of sheet thicknesses and sizes at high speed. The system does not require on-going adjustments or a pre-sorting of materials.

The improved separator and feeder system comprises a novel pair of vacuum-controlled separators acting in a cooperating, synergistic manner to automatically separate and feed letter sizes in a range between 3½ inches × 6 inches, and 10 inches × 13 inches. The system can handle all thicknesses of mail from postcard or airmail up to ½ inch thick letters.

At the beginning of the system is a stacker where the mixed mail or sheet-material is supported. A vacuum-controlled feed roller picks off one or more letters from the stack of mail and feeds them to a pair of spaced apart, vacuum-controlled separators. The first separator of the pair is set to handle the thicker envelopes at the ½ inch end of the thickness range. The second separator, located downstream of the first separator, is adjusted to process the thinner envelopes of the range such as airmail letters and postcards. The separators are spaced apart a distance approximately equal to or less than the length of a minimum envelope (approximately 5¼ inches). This specific distance is important, because the first separator adds its force to the second separator, when a letter is spaced between them. If this distance were greater, then small envelopes would tend to hang-up or "float" between the second and first separators.

A synergistic effect is obtained from the separators by means of clutching. The feed roller and the first separator are clutch controlled. Photosensors are located slightly downstream of each separator and control the clutch mechanisms. The photosensor associated with the first separator controls the feed roller clutch. When a piece of mail exits the first separator, the leading edge of the mail blocks the photosensor. A signal is sent to the feed roller clutch to disengage, so that additional pieces of mail will not be sent to the first separator. When a piece of mail exits the first separator, the leading edge of the mail blocks the photosensor. A signal is sent to the feed roller clutch to disengage, so that additional pieces of mail will not be sent to the first separator. When the trailing edge of the letter is sensed, the feed roller is once again engaged. The engaging and disengaging of the feed roller is responsive to the discharge of the first separator, and allows for a more effective separation and feeding of the mail.

Similarly the photosensor associated with the second separator controls the first separator clutch and the feed roller clutch is a like manner. The feed roller and first separator will not feed until a piece of mail occupying the second separator is completely discharged (the trailing edge is sensed).

The sensing and clutching of the first separator and feed roller provides a "traffic or flow control" to both of the separator units. The cooperation between separators is enhanced beyond the mere combining of the two separating units. Thus, a synergistic effect is provided by the two separators due to the flow control interrelationships between them.

The photosensors not only control the clutches influencing the separators and the feed roller, but they also control the supply of vacuum pressure. When either a feed roller or a separator (or both) are rotatively disengaged, the vacuum pressure is cut-off. When any one or a combination of feed and separating devices are rotatively re-engaged, they are also resupplied with vacuum pressure.

Thus, not only are the feed and separating drives rotatively deactuated and reactuated to establish a flow control, but are also controlled by the deprivation and resupply of the sheet adhering vacuum pressure. It is this vacuum pressure that provides the impulse feeding and separating of the sheet material. The control of the vacuum supply, thus aids in the disabling and re-enabling of the material feeding and separating machinery.

The separator and feeder system of this invention can be run in two different modes:

a. free running; or b. demand feed.

In the free running mode, the second separator unit is not controlled by any downstream mail-handling machinery. Mail is discharged one unit at a time, in seriatim, as fast as the separator and feeder system is allowed to run.

In the demand feed mode, the second separator is clutch controlled, and receives a feed signal from mail-handling machinery located downstream.

In either mode, the separator and feeder system of this invention will deliver inter-mixed sheet-material, envelopes letters or mail, in a one-at-a-time, seriatim fashion. There should never be any doubles or multiple feeds when the inventive separator and feeder system is working properly.

It is an object of the present invention to provide an improved separating and feeding system;

It is another object of this invention to provide a separating and feeding system having less wear, and requiring less maintenance than prior systems;

It is still another object of this invention to provide a vacuum-controlled separating and feeder system that will handle a wide range of sheet thicknesses and sizes; and It is yet another object of the inventive vacuum-controlled separating and feeding system to deliver inter-mixed sheet material at high speed, one at a time, in seriatim.

These and other objects of this invention will be better understood and will become more apparent with reference to the following detailed description taken in conjunction with the attached drawings, in which:

FIG. 7 is a schematic view of the forces tending to separate two pieces of sheet-like material in the bite of a separator of the inventive system.

Generally speaking, the invention is for a vacuum-controlled separating and feeding system for sheet-like materials, envelopes, letters and pieces of mail. The system is designed to handle a wide range of thicknesses of sheet, and deliver the sheet in seriatim to a sheet-handling device. The system comprises a stacking means, which is located at the beginning of a feed path for the sheet. A vacuum-controlled feeding means is disposed adjacent the stacking means and feeds one or several pieces of sheet from the stacking means. These sheets are fed to a first vacuum-controlled separating means disposed along the feed path downstream from the stacking means. This separating means is adjusted to separate thicker sheets of the range of thicknesses of the sheets. Thinner sheets will naturally be allowed to pass through. This first separator will separate a majority of the sheets presented to it. The separated material is then fed to a second vacuum-controlled separating means, which is located downstream of the first separating means. The second separating means is adjusted to separate the thinner sheets of the range of sheet thicknesses, but thicker sheets will be forced through, so that the full range of thicknesses will be separated. The first and second separating means act cooperatively to provide a material handling device with one sheet at a time in seriatim. Each separating comprises a forward thrusting element and an adjacent retarding element for separating multiple sheets disposed therebetween. The cooperation between the separating means is provided by a traffic control means, which monitors and controls the flow of sheets through the system.

The vacuum-controlled separating and feeding system of this invention will be explained with reference to the prior friction feeding system described in copending application Ser. No. 577,002; filed: May 13, 1975. The discussion of the friction feed system is incorporated herein with reference to FIGS. 1 through 3, for the purposes of comparison, and will be found useful in distinguishing the advantages provided by the vacuum controlled separator and feeder. Where applicable, numerical designations of similar parts and elements in the new system have been carried over from the prior friction feed system.

Figure 1:
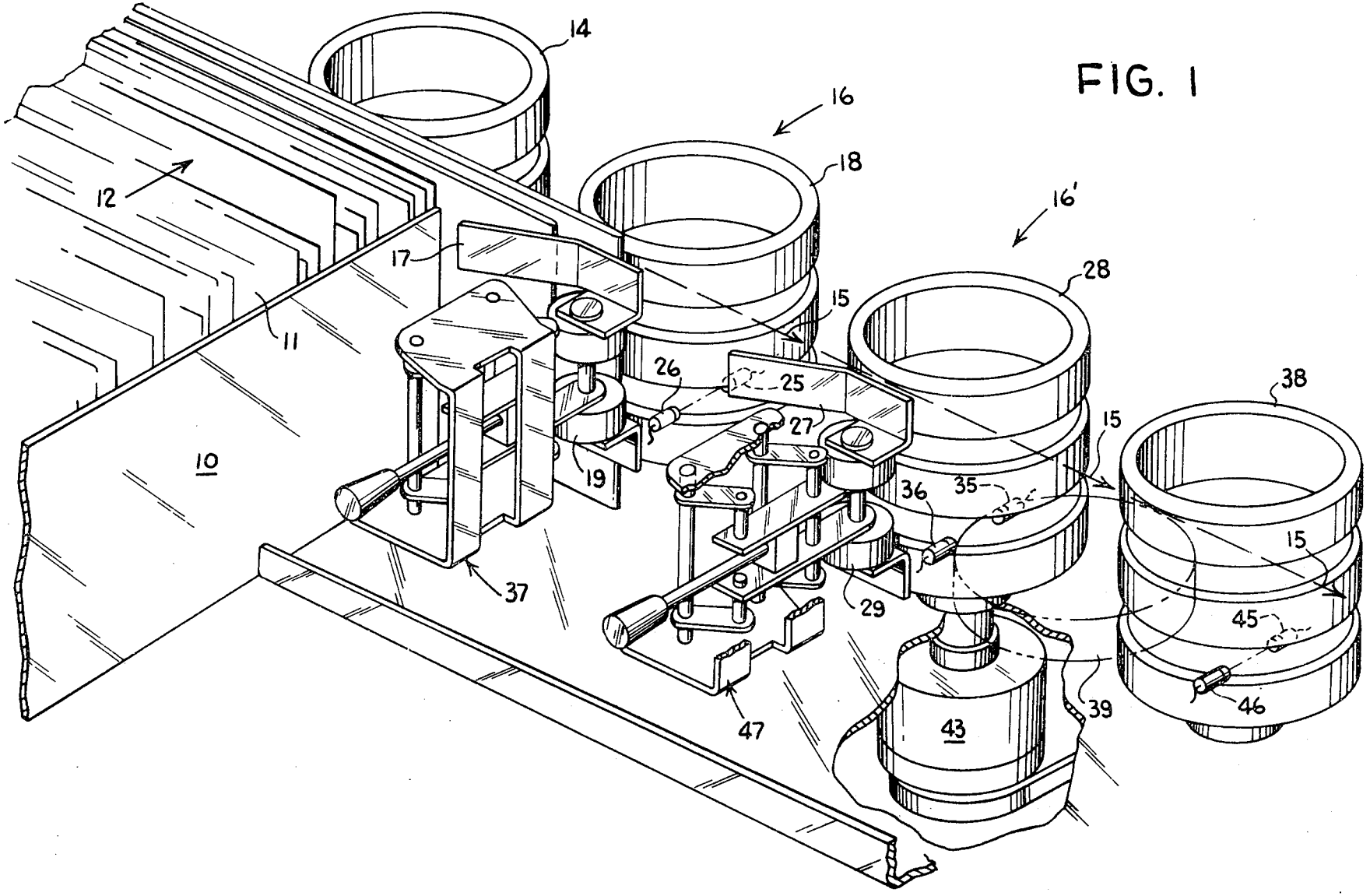
FIG. 1 is a perspective view of a frictionally-controlled separating and feeding system similar to the vacuum-controlled system of the invention.
Figure 2:
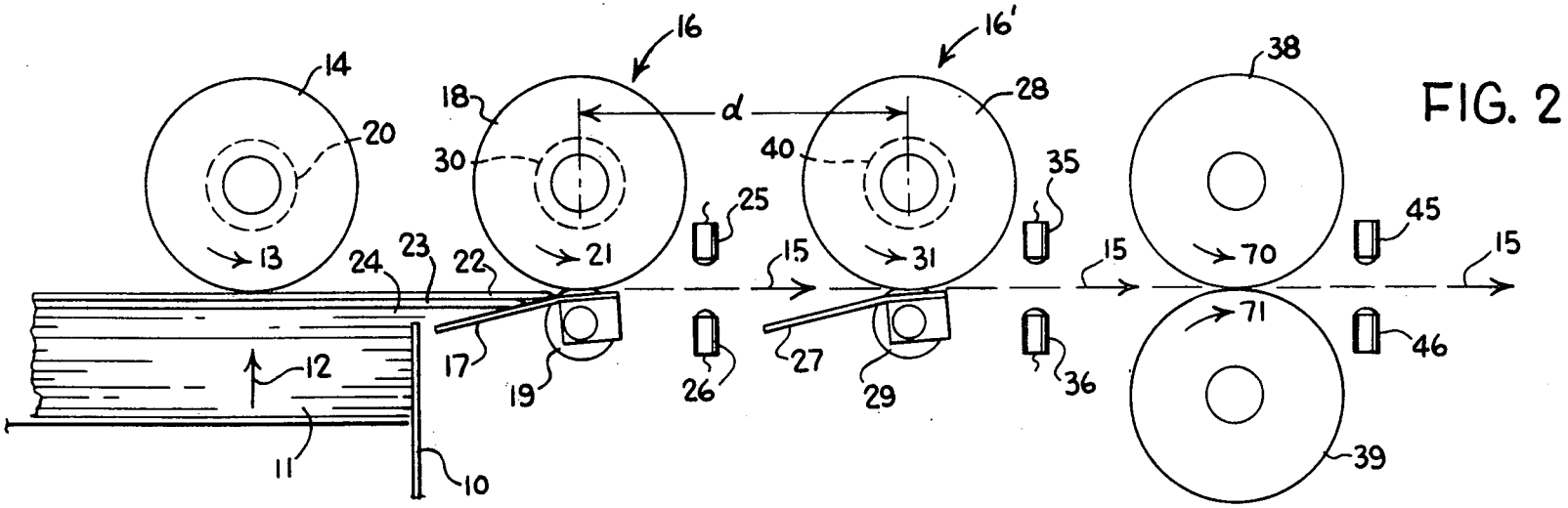
FIG. 2 is a plan view of the frictionally-controlled system of FIG. 1.

Now referring to FIGS. 1 and 2, a stacker 10 for the friction feed system is shown, for supporting and guiding a quantity of mixed mail 11. The mail 11 varies in thickness from postcard or airmail thicknesses up to one-half inch. The size of the envelopes vary from 3½ inches × 6 inches up to 10 inches × 13 inches. The letters are fed (arrow 12) towards a forward rotating (arrow 13) feed roller 14, where they are frictionally "picked-off".

The feed roller 14 starts the mail along a feed path generally shown by arrows 15. The feed roller may shingle one or more letters from the pack 11. These letters are uged towards a first separating station shown generally by arrow 16. The separator station comprises a fence 17, which is angled in such a way so as to direct pieces of mail towards a pair of rollers 18 and 19. Roller 18 is a forward rotating roller (arrow 21, FIG. 2) that frictionally engages with envelopes caught in the bit of the rollers 18 and 19, and directs the letters forward. Roller 19 is a retarding roller that frictionally engages with envelopes caught in the bite of the rollers 18 and 19. This roller tends to separate and retard multiple letters from going through the roller pair. Roller 18 has a high coefficient of friction with respect to paper of 1.3 or greater, which will positively drive pieces of mail forward. Roller 19, on the other hand, has a coefficient of friction approximately between 0.5 to 0.8, which is greater than that of paper to paper, but less than the feed roller to paper. Thus, if multiple pieces of mail enter the bite of the roller pair, the envelope 22 nearest drive roller 18 will be forced forward, and letters 23, 24, etc. will be retarded from forward movement. Roller 19 is stationary, but can be given a reverse rotation in certain applications.

Letters 22, 23 and 24 will normally tend to move together as a unit means. This is due to the pack pressure of the stack, which creates a frictional drag on each contiguous piece of mail. The reverse roller 19, however, has a greater frictional engagement with these letters, and will retard the multiple pieces of mail from moving forwards. Only letter 22 (letter nearest roller 18) will tend to move forward, because of the higher engaging friction of roller 18.

Figure 3:
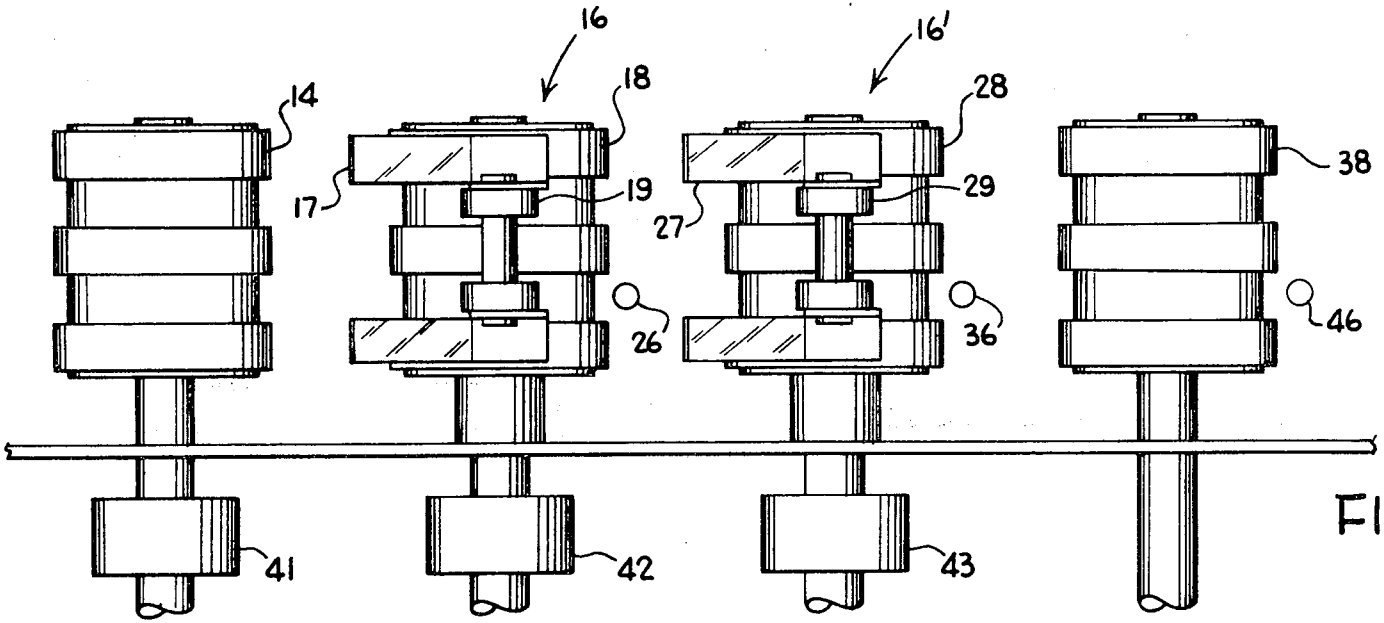
FIG. 3 is a frontal view of the frictionally-controlled system shown in FIG. 2.

The separator roller pair 18 and 19 are interdigitated as shown in FIGS. 2 and 3, so as to provide a positive intermeshing bite. This positive bite is further enhanced by spring loading (not shown) the rollers toward each other. This biasing also achieves the normal force which causes the drive.

The separator rollers 18 and 19 of station 16 have a small, adjustable overlap therebetween. This small overlap is adjusted for letters in the upper end of the thickness range (½ inch end). A lesser engaging bite is useful, since the cooperating driving force of feed roller 14 is diminished due to the drag created by the stack pressure. The small overlap aids in the entry of thicker pieces of mail to the separator.

The envelopes leaving the first pair of separating rollers are discharged to a second separator station 16'. This station has a similar pair of interdigitated separating rollers 28 and 29, and a fence 27. Roller 28 rotates in a forward direction (arrow 31) the same as roller 18, while roller 29 is stationary as is roller 19. These rollers have the same coefficients of friction as their earlier counterparts.

Separating rollers 28 and 29 have an adjustable overlap therebetween, that is set for thinner letters of the thickness range such as airmail letters or postcards. Rollers 28 and 29 are also spring biased toward each other (not shown).

Adjustment linkages 37 and 47 are schematically shown in FIG. 1. Linkage 37 is used to adjust the overlap of separator rollers 18 and 19, and linkage 47 sets the overlap for separator rollers 28 and 29.

While the second separator station 16' has rollers which are adjusted for thin pieces of mail, thicker envelopes are able to get through. This is so, because the first pair of separator rollers 18 and 19 add a forward force to the second separating station.

Stations 16 and 16' are separated by a distance *d* (FIG. 2) approximately equal to or less than a minimum envelope length (approximately 5¼ inches). This insures that even the smallest letters will not get "hung-up" (float) between the stations (will be in the bit of both separators).

Pieces of mail leaving the second separator station 16' will be discharged one at a time in seriatim to another mail-handling machine such as a facer-canceller. Rollers 38 and 39 represent the intake of this machine. Both rollers are shown rotating in a forward direction (arrows 70 and 71; FIG. 2).

The feed roller 14 and separator rollers 18 and 28, are controlled by clutches 41, 42, 43, respectively, as shown in FIG. 3. These clutches rotatively engage and disengage these rollers from driving the pieces of mail along feed path 15. Each clutch is activated and deactivated by a photosensor device, whose light path intersects the feed path 15. Each photosensor unit comprises a light emitting diode (LED), and a phototransistor.

Photosensor elements 25, 26 are shown immediately downstream of the first separator rollers (FIGS. 1 and 2), and are used to control the feeder clutch 41 (FIG. 3).

A second photosensor element pair 35, 36 (FIGS. 1 and 2) is shown immediately downstream of the second separator rollers, and is used to actuate clutches 41 and 42 (FIG. 3) controlling the feed roller 14 and the first separator roller 18, respectively.

In the "demand feed" mode, clutches 41, 42 and 43 (FIGS. 1 and 3) controlling the feed roller 14, and the first and second separator rollers 18 and 28, respectively, can be actuated by photosensor elements 45, 46. Each of the drive rollers 14, 18 and 28 are mounted to their respective shafts by overrunning clutches 20, 30 and 40 (FIG. 2), respectively. These over-running clutches allow the mail to be pulled forward by subsequent drive rollers, when any of these rollers are disengaged by their respective driving clutches 41, 42 and 43. If this were not so, when any of the drive rollers 14, 18 and 28 were stopped from rotating, they would retard the forward progress of the letters in their bite.

OPERATION OF THE FRICTIONALLY-CONTROLLED SYSTEM

As aforementioned, a stack of inter-mixed mail or sheet material is introduced to feed roller 14 from the stacker 10. The feed roller 14 shingles the envelopes in feeding them to a first separator station 16. When an envelope is discharged from the separator rollers 18 and 19, the leading edge of the letter will break the light path between the photosensor elements 25 and 26. When this occurs, clutch 41 (FIG. 3) controlling feed roller 14 is deactivated by a signal from the photosensor. The feed roller 14 will now cease to feed any more pieces of mail to the first separator until the trailing edge of the discharged letter passes the last pair of photosensor elements.

As a letter is discharged from separator station 16, it enters a second pair of separator rollers 28 and 29 of separator station 16'. As previously mentioned, this separator is adjusted for thinner pieces of mail, but is able to pass thicker envelopes due to the additional drive force provided by the first separator rollers. When a piece of mail is discharged from rollers 28 and 29, the leading edge of the envelope will break the light path between photosensor elements 35 and 36. A signal is now sent to deactuate clutches 41 and 42 (FIG. 3). Feed roller 14 and separator roller 18 will then cease to drive any mail until the trailing edge of the discharged envelope passes photosensor elements 35 and 36.

In the "free running" mode, pieces of mail will be discharged one at a time in seriatim from the second separator station 16'. The speed by which the letters are expelled will depend upon the speed of driving rollers 14, 18 and 28.

In the demand feed mode of operation, all the drive rollers including the second separator roller 28 are clutch controlled. The clutches 41, 42 and 43 will rotatively engage and disengage their respective drive rollers depending upon an extraneous signal (or lack of signal) from a contiguous mail-handling device. One way of providing such a signal is shown in FIGS. 1 and 2 by photosensor elements 45 and 46.

When an envelope enters the mail-handling device feed-in rollers 38 and 39, it is discharged past photosensor elements 45 and 46. The leading edge of the letter will provide a signal to clutches 41, 42 and 43 (FIG. 3) to deactuate these clutches, and rotatively disengage rollers 14, 18 and 28. Rollers 14, 18 and 28 will not feed another envelope until the trailing edge of the letter positioned in front of photosensor elements 45 and 46 moves past.

Thus, only one letter at a time will be fed to the mail handling device. The speed at which letters will be discharged can be regulated by the speed of rollers 38 and 39, or other extraneous conditions of the mail-handling device.

THE VACUUM-CONTROLLED SYSTEM

Figure 4:
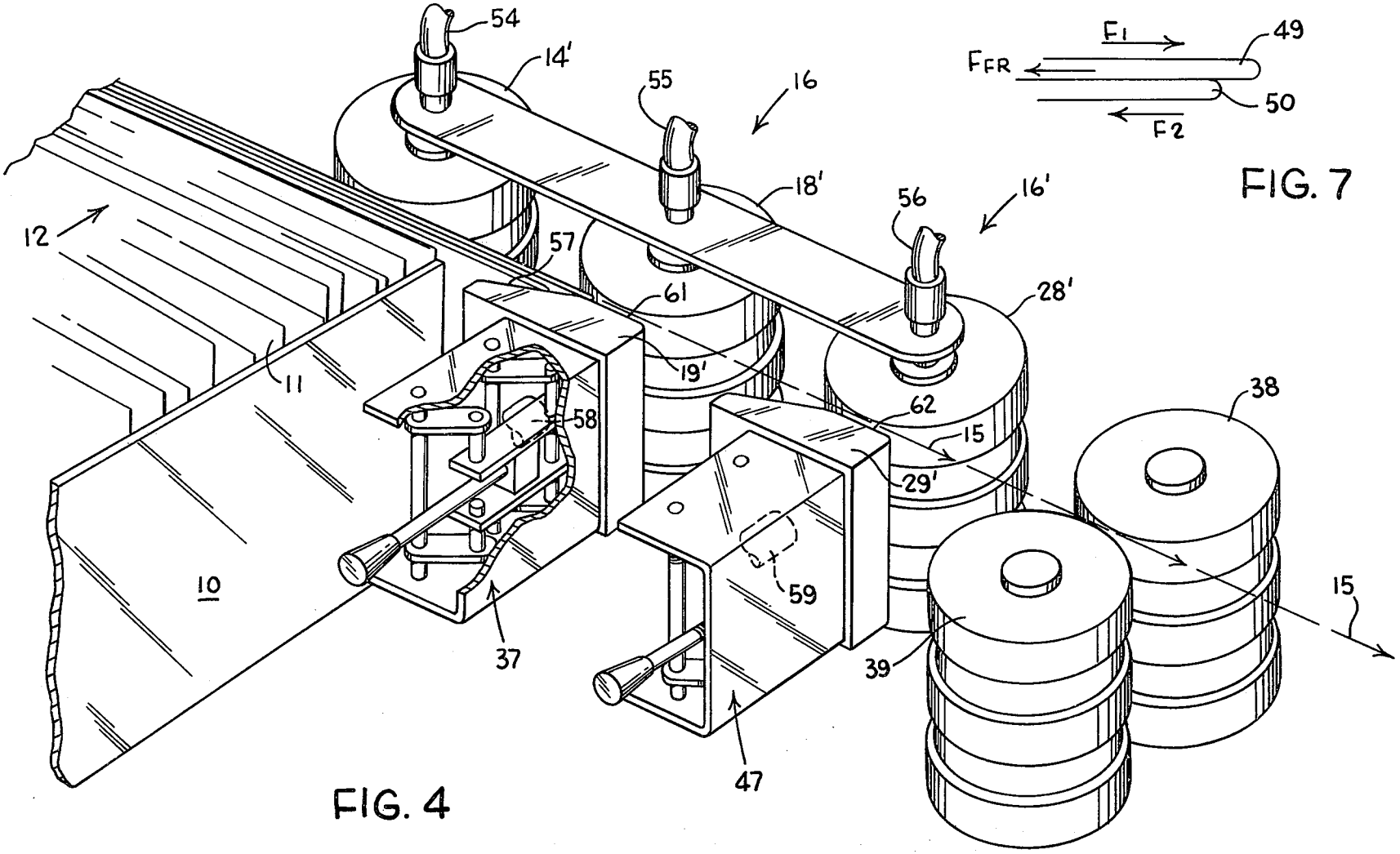
FIG. 4 is a perspective view of a vacuum-controlled material separating and feeding system of this invention, similar to that shown in FIG. 1.
Figure 5:
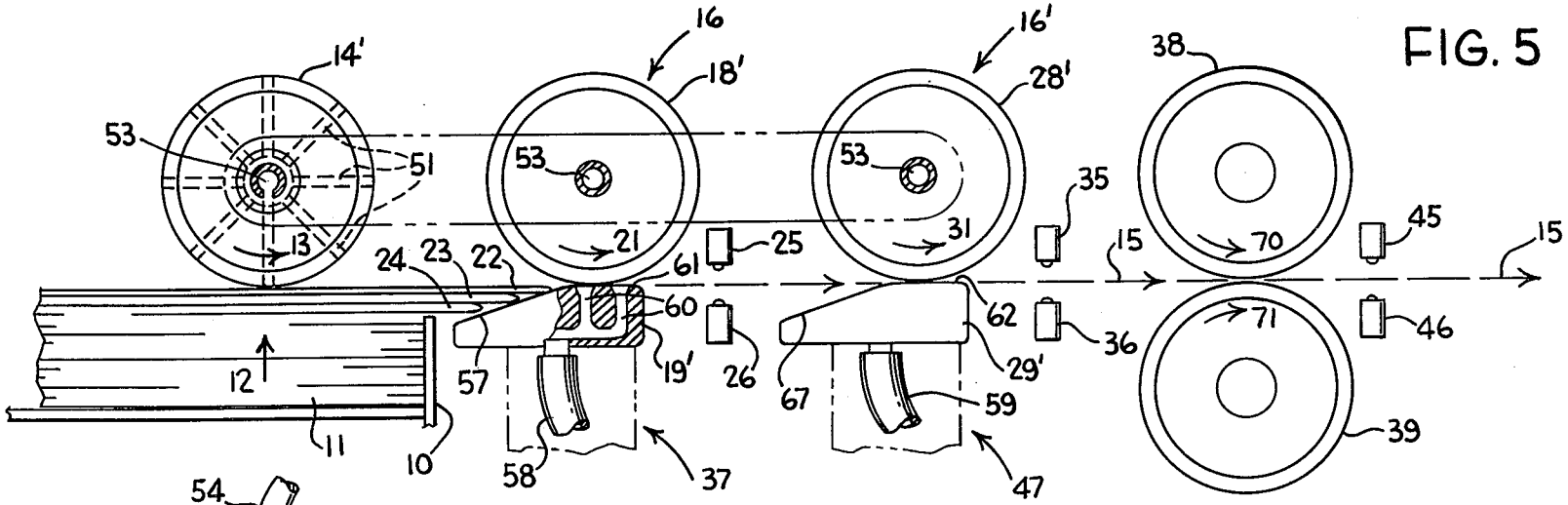
FIG. 5 is a plan view of the vacuum-controlled system of FIG. 4.
Figure 6:
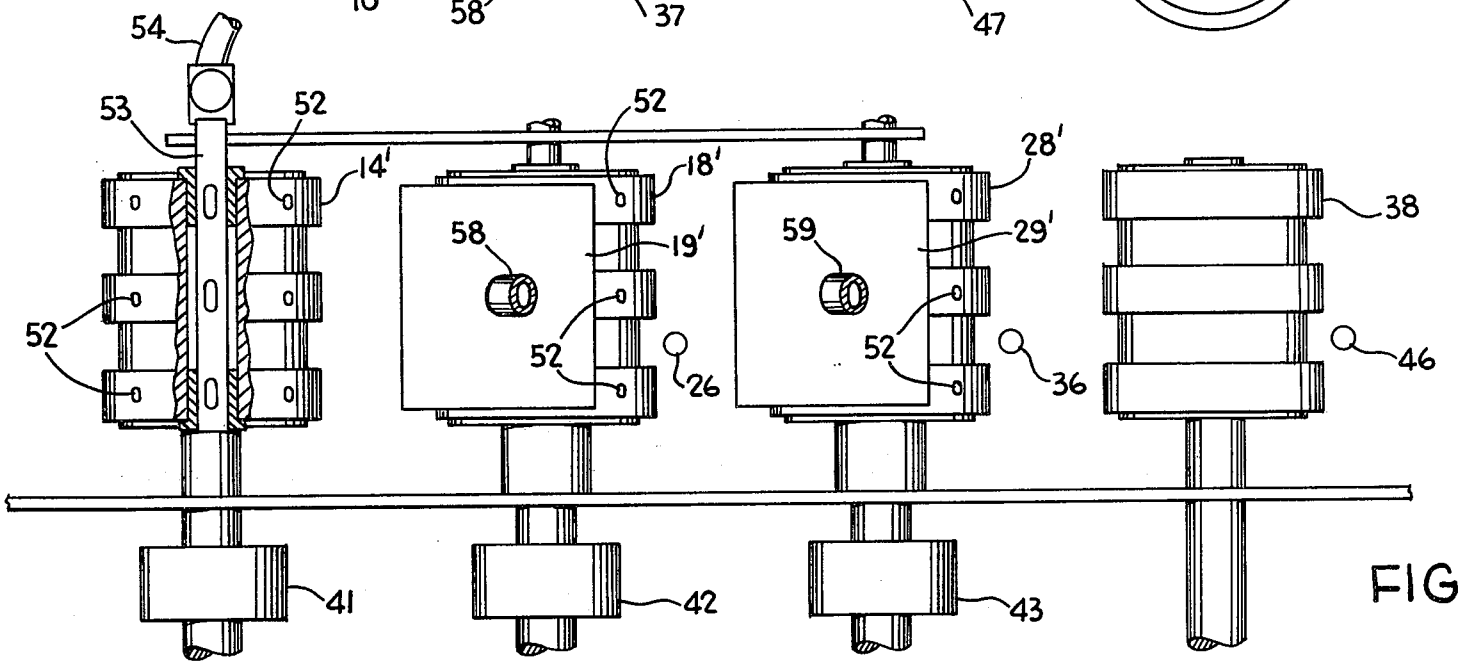
FIG. 6 is a frontal view of the inventive system depicted in FIG. 5.

Now with reference to FIGS. 4 through 6, the inventive vacuum-controlled separating and feeding system is shown. FIG. 7 shows a schematic diagram of two envelopes or sheets being separated by one of the separators 16 or 16'. Envelope 49 is being separated from envelope 50. Envelope 49 is being propelled forwardly in the direction of Force $F_1$, and envelope 50 is being retarded in the direction of Force $F_2$. The Force $F_{FR}$ is the frictional force between the envelopes 49 and 50, as envelope 49 pulls away from envelope 50. In both separating and feeding systems, (friction and vacuum feed) the relationship for the separating forces are given as:

$$F_1 > F_2 > F_{FR}$$

In the friction feed system of FIGS. 1–3, $F_1$ is equal to the frictional thrust of rollers 18 or 28 against the envelope 49, and is expressed as:

$$F_1 = \mu_{RP_1} N$$

where:

$\mu_{RP_1}$ is equal to the coefficient of friction of the rubber roller (18 or 28) against paper; and N is the normal force exerted by the bite of the separator (16 or 16').

Similarly $F_2$ is expressed as:

$F_2 = \mu_{RP_2} N$ where:

$\mu_{RP_2}$ is the frictional coefficient between the retarding roller 19 or 29 (stone) against envelope 50 (paper).

$F_{FR}$ is expressed as:

$F_{FR} = \mu_{PP} N$ where:

$\mu_{PP}$ is the coefficient of friction between the envelopes 49 and 50 (paper against paper).

It follows from the first expression, that:

$$\mu_{RP_1} > \mu_{RP_2} > \mu_{PP}.$$

(where all N's are equal)

In a vacuum feed system as will be described hereinafter with reference to FIGS. 4–6, the relationship of the forces is the same as the frictional feed, i.e. $F_1 > F_2 > F_{FR}$.

The difference between the two systems, however, is that the forces $F_1$ and $F_2$ are no longer frictional forces, but are now respectively impulses and vacuum retarding forces. In other words, friction is attempted to be reduced towards zero, such that:

$$\mu_{RP_1} \text{ and } \mu_{RP_2} \rightarrow 0.$$

To this end, the friction rollers 14, 18 and 28 of FIG. 1, have now been replaced by vacuum feed rollers 14', 18' and 28' as shown in FIGS. 4 through 6. Frictional retarding rollers 19 and 29 have been also replaced by vacuum retarding shoes 19' and 29'. Retarding shoes 19' and 29' are biased toward rollers 18' and 28', respectively, in order to create a bite or normal force N for the separators.

Feed wheels 14', 18' and 28' rotate as before in a counterclockwise direction as illustrated by arrows 13, 21 and 31, respectively.

Each of these wheels have internal ducts 51 (shown only for wheel 14' in FIG. 5). These internal ducts 51 terminate on the surface of these wheels as suction holes 52 as depicted in FIG. 6.

Each duct 51 in each wheel originates from a central core 53 shown in FIG. 5. A vacuum pressure is created in each central core 53 via external pressure hoses 54, 55 and 56, respectively, as illustrated in FIG. 4. The suction provided in cores 53, manifests itself in an adhering suction at the surface of each wheel via suction holes 52.

As a sheet of material, or an envelope, passes in proximity to these suction holes 52, it will adhere to the wheel due to the negative pressure (vacuum). The adherence of the sheet will be transformed into an impulsive force, however, due to the rotation of these wheels. This impulsive force will result in propelling the sheet forward along the feed path (arrows 15).

The retarding shoes 19' and 29' are similarly supplied with a vacuum pressure via external hoses 58 and 59, respectively. Shoes 19' and 29' have internal ducts 60, (shown only for shoe 19' in FIG. 5) that terminate as suction holes on surfaces 61 and 62, respectively. Shoes 19' and 29' retard the double envelope 50 (FIG. 7), for example, by causing the envelope to adhere to respective surfaces 61 and 62. The shoes 19' and 29' have tapered surfaces 57 and 67, respectively, for guiding sheet material into the bite of the respective separators 16 and 16'.

OPERATION OF THE INVENTIVE VACUUM-CONTROL SYSTEM

The vacuum-controlled system as depicted in FIGS. 4 through 6, operates in almost all respects as does the friction feed system of FIGS. 1 through 3. The notable differences are as follows:

A. Photosensor element pairs 25, 26; 35, 36; and 45, 46 cut-off and resupply the vacuum pressure to their associated wheels 14', 18' and 28', when they deactuate and actuate clutches 41, 42 and 43.

In other words, photosensor elements 25 and 26 deactuate clutch 41, when their light path is blocked and then reactuate the clutch 41, when the light path is remade. At the same time, this pair of photosensor elements cut-off the vacuum supply to wheel 14' via hose 54 when blocked and then resupply the vacuum pressure when the light path is remade. Thus, when wheel 14' ceases to rotate, there will likewise be no suction at holes 52 of this wheel.

Similarly, the photosensor elements 35 and 36 control wheels 14' and 18' in the same way; i.e. when clutches 41 and 42 are deactuated and reactuated respectively, disabling the rotative drive of wheels 14' and 18', the vacuum pressure is simultaneously cut-off and then resupplied to these wheels via hoses 54 and 55, respectively.

Photosensor pair 45 and 46 control wheels 14', 18' and 28' in the same fashion.

The vacuum supplied to retarding shoes 19' and 29' remains constantly in force despite the intermittency of the pressure supplied to the driving rollers 14', 18' and 28'.

B. Wheels 14', 18' and 28' are made from frictionless materials such as Teflon II to reduce wear, as well as surfaces 57, 61, 67 and 62 of the retarding shoes. The reduction of friction will make possible longer machine life and reduced maintenance, in keeping with the stated objectives of this invention.

Of course, many obvious changes in the invention can be made. For example, the photosensors can be replaced by other types of proximity or limit-type switches. Driving speeds, and distances between various elements such as drive elements, photosensors, and between photosensors and drive elements may vary depending upon the mode of operation of the invention or the overall purpose of the system.

All such changes that will occur to the skilled practitioner in this art, are deemed to lie within those limits encompassed by the invention.

The spirit and scope of the invention is represented by the appended claims.

What is claimed is:

1. An automatic, vacuum-controlled, material separating and feeding system separating a range of intermixed thicknesses of sheet-like material and feeding the separated sheet-like material in seriatim to a material-handling device, said material separating feeder system comprising:

means defining a material handling feed path;

stacking means disposed at the beginning of said feed path for stacking a quantity of inter-mixed thicknesses of sheet-like material;

a. vacuum-controlled feeding means disposed adjacent said stacking means for feeding a portion of said quantity of material towards a first separating means;

a first vacuum-controlled separating means disposed along said feed path downstream from said stacking means for generally separating thicker sheet-like material of said range of intermixed thicknesses, and feeding the separated material towards a second vacuum-controlled separating means, said first separating means comprising a first forward material thrusting element and a first adjacent material retarding element for separating multiple sheet-like materials disposed therebetween, a first indpendent clutching means for engaging and disengaging said first forward material thrusting element, said first forward material thrusting element including an over-running clutch for allowing sheet-like material to be pulled forward by a subsequent forward material thrusting element when said first forward material thrusting element is disengaged; and a second vacuum-controlled separating means disposed along said feed path downstream from said first vacuum-controlled separating means for generally separating thinner sheet-like material of said range of inter-mixed thicknesses, and feeding the separated material towards a material-handling device, said second separating means disposed along said feed path downstream from said first separating means a distance less than a minimum length for said sheet-like material in said range of sheet-like materials, so that at one time during the separation of said sheet-like material, said sheet-like material will be in the bite of both separating means, said second separating means comprising a second forward material thrusting element and a second adjacent material retarding element for separating multiple sheet-like materials disposed therebetween, a second clutching means for engaging and disengaging said second forward material thrusting element, said second forward material thrusting element including an over-running clutch for allowing sheet-like material to be pulled forward by a subsequent forward material thrusting element when said second forward material thrusting element is disengaged, said second vacuum-controlled separating means working cooperatively with said first vacuum-controlled separating means, such that said sheet-like material is fed to said material-handling device one sheet at a time in seriatim.

2. The automactic, vacuum-controlled, material separating and feeding system of claim 1, wherein each of said first and said second vacuum-controlled separating means comprise a forward rotating, vacuum-controlled feed roller, and a complementary, vacuum-controlled retarding element.

3. The automatic, vacuum-controlled, material separating and feeding system of claim 1, wherein said vacuum-controlled feeding means comprises a feed roller that rotatively and adhesively engages with sheet-like material of the stacking means, and impulsively feeds said material towards the first vacuum-controlled separating means, and a first clutch operatively connected to said feed roller for causing said feed roller to rotatively engage with, and disengage from, said sheet-like material of said stacking means.

4. The automatic, vacuum-controlled, material separating and feeding system of claim 3, further comprising a first sensing means disposed along said feed path adjacent said first vacuum-controlled separating means on a downstream side thereof, said first sensing means for sensing a leading and trailing edge of sheet like material leaving said first separating means and providing first electrical signals in response to the sensing of the leading and trailing edge, and means for coupling these first signals to said first clutch, whereby the feed roller is rotatively disengaged from, and rotatively engaged into, feeding said sheet-like material of said stacking means.

5. The automatic, vacuum-controlled, material separating and feeding system of claim 4, further comprising a first vacuum-control means for supplying said feed roller with vacuum pressure, said first electrical signals being coupled to said first vacuum-control means, whereby the sensing of the leading and trailing edge of said sheet-like material cuts-off and then restores the vacuum pressure to the feed roller.

6. The automatic, vacuum-controlled, material separating and feeding system of claim 5, further comprising a second sensing means disposed along said feed path adjacent said second vacuum-controlled separating means on a downstream side thereof, said second sensing means for sensing a leading and trailing edge of sheet-like material leaving said second vacuum-controlled separating means and providing second electrical signals in response to the sensing of the leading and trailing edge, a second clutch operatively connected to said first vacuum-controlled separating means for causing said first vacuum-controlled separating means to rotatively engage with, and rotatively disengage from, said sheet-like material, and means for coupling the second electrical signals to said first and said second clutches.

7. The automatic, vacuum-controlled, material separating and feeding system of claim 6, further comprising a second vacuum-control means for supplying said first separating means with vacuum pressure, said second electrical signals being coupled to said first and second vacuum-control means, whereby the sensing of the leading and trailing edge of the sheet-like material by the second sensing means cuts-off and then restores the vacuum pressure to the feed roller and the first separating means.

8. The automatic, vacuum-controlled, material separating and feeding system of claim 7, further comprising a third clutch operatively connected to said second vacuum-controlled separating means, means for providing demand feed signals from said material-handling device, and means for coupling the demand feed signal to said first, second, and third clutches for causing said feeding means, and said first and second separating means to rotatively disengage from, and rotatively engage with, said sheet-like material.

9. The automatic, vacuum-controlled, material separating and feeding system of claim 8, further comprising a third vacuum-control means for supplying vacuum pressure to said second separating means, said demand feed signals being coupled to said first, second, and third vacuum-control means, whereby the vacuum pressure to the first, second, and third vacuum-control means is alternately cut-off and then restored.

10. An automatic, vacuum-controlled, envelope separating and feeding system for separating a range of intermixed thicknesses and sizes of envelopes, and feeding the separated envelopes in seriatim to an envelope-handling device, said envelope separating and feeding system comprising:

means defining an envelope feed path;

stacking means disposed at the beginning of said feed path for stacking a quantity of inter-mixed thicknesses and sizes of envelopes;

a vacuum-controlled feeding means disposed adjacent said stacking means for feeding a portion of said quantity of envelopes towards a separating means;

a first and second vacuum-controlled separating means disposed along said feed path downstream of said stacking means, the second separating means being disposed downstream from the first separating means by a length less than that of a minimum size envelope length, said first and second separating means each comprising a forward envelope thrusting element and an adjacent envelope retarding element for separating multiple envelopes disposed therebetween, said first and second separating means further comprising independent clutching means for engaging and disengaging each of said forward envelope thrusting elements, respectively, and an over-running clutch for each of said forward envelope thrusting elements for allowing an envelope to be pulled forward when its respective forward envelope thrusting element is disengaged.

11. The automatic, vacuum-controlled, envelope separating and feeding system of claim 10, wherein said first vacuum-controlled separating means generally separates thicker envelopes in a range of inter-mixed envelope thicknesses.

12. The automatic, vacuum-controlled, envelope separating and feeding system of claim 10, wherein said second vacuum-controlled separating means generally separates thinner envelopes in a range of inter-mixed envelope thicknesses.

13. The automatic, vacuum-controlled, envelope separating and feeding system of claim 10, wherein each of said first and second vacuum-controlled separating means comprise a forward rotating vacuum-controlled feed roller, and a complementary retarding element.

14. The automatic, vacuum-controlled, envelope separating and feeding system of claim 10, wherein said vacuum-controlled feeding means comprises a feed roller that rotationally and adhesively engages with envelopes of the stacking means, and feeds said envelopes towards the first vacuum-controlled separating means, and a first clutch operatively connected to said feed roller for causing said feed roller to rotatively engage with, and disengage from, the envelopes of said stacking means.

15. The automatic, vacuum-controlled, envelope separating and feeding system of claim 14, further comprising a first sensing means disposed along said feed path adjacent said first vacuum-controlled separating means on a downstream side thereof, said first sensing means for sensing a leading and trailing edge of an envelope leaving said first vacuum-controlled separating means, and providing first electrical signals in response to the sensing of the leading and trailing edges, and means for coupling these first electrical signals to said first clutch, whereby the feed roller is alternately rotatively disengaged from and rotatively engaged into, feeding the envelopes of said stacking means.

16. The automatic, vacuum-controlled, envelope separating and feeding system of claim 15, further comprising a first vacuum-control means for supplying said feed roller with vacuum pressure, said first electrical signals being coupled to said first vacuum-control means, whereby the sensing of the leading and trailing edge of said envelope cuts off and then restores the vacuum pressure to the feed roller.

17. The automatic, vacuum-controlled, envelope separating and feeding system of claim 16, further comprising a second sensing means disposed along said feed path adjacent said second vacuum-controlled separating means on a downstream side thereof, said second sensing means for sensing a leading and trailing edge of an envelope leaving said second vacuum controlled separating means, and providing second electrical signals in response to the sensing of the leading and trailing edges, a second clutch operatively connected to said first vacuum controlled separating means for causing said first vacuum controlled separating means to engage with, and disengage from, any envelopes disposed therein, and means for coupling the second electrical signals to said first and second clutches.

18. The automatic, vacuum-controlled, envelope separating and feeding system of claim 17, further comprising a second vacuum-control means for supplying said first separating means with vacuum pressure, said second electrical signals being coupled to said first and second vacuum-control means, whereby the sensing of the leading and trailing edge of the second sensing means cuts-off and then restores the vacuum pressure to the feed roller and the first separating means.

19. The automatic vacuum-controlled, envelope separating and feeding system of claim 18, further comprising a third clutch operatively connected to said second vacuum-controlled separating means, means for providing demand feed signals from said envelope-handling device, and means for coupling the demand feed signals to said first, second, and third clutches for causing said feeding means, and said first and second separating means to rotatively disengage from, and rotatively engage with, said sheet-like material.

20. The automatic, vacuum-controlled, envelope separating and feeding system of claim 19, further comprising a third vacuum-control means for supplying vacuum pressure to said second separating means and said demand feed signals being coupled to said first, second and third vacuum-control means, whereby the vacuum pressure to the first, second and third vacuum-control means is alternately cut-off and then restored.

21. An automatic, vacuum-controlled, envelope separating and feeding system separating a range of inter-mixed thicknesses of envelopes, and feeding the separated envelopes in seriatim to an envelope-handling device, said envelope separating and feeding system comprising:

means defining an envelope feed path;

stacking means disposed at the beginning of said feed path for stacking a quantity of inter-mixed thicknesses of envelopes;

a vacuum-controlled feeding means disposed adjacent said stacking means for feeding a portion of said quantity of envelopes towards a first vacuum-controlled separating means;

a first vacuum-controlled separating means disposed along said feed path downstream from said stacking means for generally separating thicker envelopes in said range of inter-mixed thicknesses, and feeding the separated envelopes towards a second vacuum-controlled separating means, said first separating means comprising a first forward envelope thrusting element and a first adjacent envelope retarding element for separating multiple envelopes disposed therebetween, a first independent clutching means for engaging and disengaging said first forward envelope thrusting element, said first forward envelope thrusting element including an over-running clutch for allowing envelopes to be pulled forward by a subsequent forward envelope thrusting element when said first forward envelope thrusting element is disengaged; and a second vacuum-controlled separating means disposed along said feed path downstream from said first vacuum-controlled separating means for generally separating thinner envelopes in said range of inter-mixed thicknesses, and feeding the separated envelopes towards an envelope-handling device, said second separating means disposed along said feed path downstream from said first separating means a distance less than a minimum length for an envelope in said range of envelopes, said second separating means comprising a second forward envelope thrusting element and a second adjacent envelope retarding element for separating multiple envelopes disposed therebetween, a second clutching clutching means for engaging and disengaging said second forward envelope thrusting element, said second forward envelope thrusting element including an over-running clutch for allowing envelopes to be pulled forward by a subsequent forward envelope thrusting element when said second forward envelope thrusting element is disengaged, said second vacuum-controlled separating means working cooperatively with said first vacuum-controlled separating means, such that said envelopes are fed to said envelope-handling device one envelope at a time in seriatim.

22. The automatic, vacuum-controlled, envelope separating and feeding system of claim 21, wherein each of said first and second vacuum-controlled separating means comprise a forward rotating, vacuum-controlled feed roller, and a complementary retarding element.

23. The automatic, vacuum-controlled, envelope separating and feeding system of claim 21, wherein said vacuum-controlled feeding means comprises a vacuum-controlled feed roller that rotatively and adhesively engages with envelopes of the stacking means, and feeds said envelopes towards the first vacuum-controlled separating means, and a first clutch operatively connected to said vacuum-controlled feed roller for causing said feed roller to rotatively engage with, and disengage from, the envelopes of said stacking means.

24. The automatic, vacuum-controlled, envelope separating and feeding system of claim 23, further comprising a first sensing means disposed along said feed path adjacent said first vacuum-controlled separating means on a downstream side thereof, said first sensing means for sensing a leading and trailing edge of an envelope leaving said first vacuum-controlled separating means and providing first electrical signals in response to the sensing of the leading and trailing edges, and means for coupling these first electrical signals to said first clutch, whereby the feed roller is rotatively disengaged from, and rotatively engaged into, feeding the envelopes of said stacking means.

25. The automatic, vacuum-controlled, envelope separating and feeding system of claim 24, further comprising a first vacuum-control means for supplying said feed roller with vacuum pressure, said first electrical signals being coupled to said first vacuum-control means, whereby the sensing of the leading and trailing edge of said envelope cuts-off and then restores the vacuum pressure to the feed roller.

26. The automatic, vacuum-controlled, envelope separating and feeding system of claim 25, further comprising a second sensing means disposed along said feed path adjacent said second vacuum-controlled separating means on a downstream side thereof, said second sensing means for sensing a leading and trailing edge of an envelope leaving said second vacuum-controlled separating means and providing second electrical signals in response to the sensing of the leading and trailing edges, a second clutch operatively connected to said first vacuum-controlled separating means for causing said first vacuum-controlled separating means to engage with, and disengage from, any envelopes disposed therein, and means for coupling the second electrical signals to said first and second clutches.

27. The automatic, vacuum-controlled, envelope separating and feeding system of claim 26, further comprising a second vacuum-control means for supplying said first separating means with vacuum pressure, said second electrical signals being coupled to said first and second vacuum-control means, whereby the sensing of the leading and trailing edge of the envelope by the second sensing means cuts-off and then restores the vacuum pressure to the feed roller and the first separating means.

28. The automatic, vacuum-controlled, envelope separating and feeding system of claim 27, further comprising a third clutch operatively to said second vacuum-controlled separating means, means for providing demand feed signals from said envelope-handling device, and means for coupling the demand feed signals to said first, second and third clutches for causing said vacuum-controlled feeding means, and said first and second vacuum-controlled separating means to rotatively engage with, annd rotatively disengage from, feeding said sheet-like material.

29. An automatic, vacuum-controlled, sheet-material separating and feeding system for separating a range of inter-mixed sheet material, and feeding said sheet materials in seriatim to a material-handling device, said sheet-material separating and feeding system comprising:

means defining a sheet-material feed path;

stacking means disposed at the beginning of said feed path for stacking a quantity of inter-mixed sheet material;

a vacuum-controlled feeding means disposed adjacent said stacking means for feeding a portion of said quantity of sheet-material towards a separating means;

a first vacuum-controlled separating means disposed along said feed path downstream from said stacking means for separating sheet-material received from said vacuum-controlled feeding means, said first separating means comprising a first forward material thrusting element and a first adjacent material retarding element for separating multiple sheet-like materials disposed therebetween, a first independent clutching means for engaging and disengaging said first forward material thrusting element, said first forward material thrusting element including an over-running clutch for allowing sheet-like material to be pulled forward by a subsequent forward material thrusting element when said first forward material thrusting element is disengaged;

a second vacuum-controlled separating means disposed along said feed path downstream of said first vacuum-controlled separating means for separating sheet-material received from said first vacuum-controlled separating means, said second separating means disposed along said feed path downstream from said first separating means a distance less than a minimum length for said sheet-like material in said range of sheet-like materials, so that at one time during the separation of said sheet-like material, said sheet-like materials will be in a bite of both separating means, said second separating means comprising a second forward material thrusting element and a second adjacent material retarding element for separating multiple sheet-like materials disposed therebetween, a second clutching means for engaging and disengaging said second forward material thrusting element, said second forward material thrusting element including an over-running clutch for allowing sheet-like material to be pulled forward by a subsequent forward material thrusting element when said second forward material thrusting element is disengaged; and traffic control means cooperatively interconnecting said vacuum-controlled feeding means, said first vacuum-controlled separating means, and said second vacuum-controlled separating means, whereby an enhanced separating and feeding effect is achieved between the vacuum-controlled feeding means, the first vacuum-controlled separating means, and the second vacuum-controlled separating means.

* * * * *

UNITED STATES PATENT OFFICE

CERTIFICATE OF CORRECTION

Patent No. 4,030,723 Dated June 21, 1977

Inventor(s) Robert Irvine et al.

It is certified that error appears in the above-identified patent and that said Letters Patent are hereby corrected as shown below:

Column 2, line 9, change "is" to --in--.

Column 3, line 45, insert --means-- after "separating".

Column 4, line 8, change "uged" to --urged--;

line 31, change "means" to --mass--;

line 36, change "forwards" to --forward--.

Column 5, line 12, change "bit" to --bite--.

Column 6, line 17, insert quotation marks around the words demand feed".

IN THE CLAIMS:

Claim 1, column 9, line 10, change "indpendent" to --independent-- line 31, change "the" to --a--.

UNITED STATES PATENT OFFICE

CERTIFICATE OF CORRECTION

Patent No. 4,030,723 Dated June 21, 1977

Inventor(s) Robert Irvine et al.

It is certified that error appears in the above-identified patent and that said Letters Patent are hereby corrected as shown below:

Claim 2, column 9, line 49, change "automactic" to --automatic--.

Claim 21, column 13, line 23, omit "clutching".

Claim 28, column 14, line 3, insert --connected-- after "operatively";

line 10, change "annd" to --and--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*